US010231512B2

(12) United States Patent
Lucca

(10) Patent No.: US 10,231,512 B2
(45) Date of Patent: Mar. 19, 2019

(54) THREE LAYER SHOE CONSTRUCTION WITH IMPROVED CUSHIONING AND TRACTION

(71) Applicant: Footwear Unlimited Inc., Fenton, MO (US)

(72) Inventor: Fabio Lucca, Valley Park, MO (US)

(73) Assignee: Footwear Unlimited Inc., Fenton, MO (US)

( * ) Notice: Subject to any disclaimer, the term of this patent is extended or adjusted under 35 U.S.C. 154(b) by 0 days.

(21) Appl. No.: 15/658,558

(22) Filed: Jul. 25, 2017

(65) Prior Publication Data

US 2019/0029363 A1 Jan. 31, 2019

(51) Int. Cl.

| | |
|---|---|
| ***A43B 13/12*** | (2006.01) |
| ***A43B 13/18*** | (2006.01) |
| ***A43B 13/04*** | (2006.01) |
| ***A43B 13/14*** | (2006.01) |
| ***A43B 13/22*** | (2006.01) |
| ***A43B 1/00*** | (2006.01) |

(52) U.S. Cl.

CPC ..... *A43B 13/186* (2013.01); *A43B 1/0045* (2013.01); *A43B 13/04* (2013.01); *A43B 13/122* (2013.01); *A43B 13/125* (2013.01); *A43B 13/141* (2013.01); *A43B 13/188* (2013.01); *A43B 13/223* (2013.01)

(58) Field of Classification Search

CPC ..... A43B 13/00; A43B 13/12; A43B 13/14; A43B 13/141; A43B 13/22

USPC ..... 36/25 R, 30 R, 30 A, 31, 59 R, 59 C

See application file for complete search history.

(56) References Cited

U.S. PATENT DOCUMENTS

| | | | | |
|---|---|---|---|---|
| 1,568,064 | A | 1/1926 | Goldman | |
| 4,378,643 | A * | 4/1983 | Johnson | A43B 13/223 36/129 |
| 4,641,438 | A | 2/1987 | Laird et al. | |
| 4,794,707 | A | 1/1989 | Franklin et al. | |
| 4,866,861 | A | 9/1989 | Noone | |
| 4,942,679 | A | 7/1990 | Brandon et al. | |
| 5,224,277 | A | 7/1993 | Sang Do | |
| 5,353,526 | A | 10/1994 | Foley et al. | |
| 6,038,790 | A | 3/2000 | Pyle et al. | |
| 6,061,929 | A | 5/2000 | Ritter | |
| 6,161,315 | A | 12/2000 | Dalton | |
| 6,276,073 | B1 | 8/2001 | Curley, Jr. | |
| 6,705,027 | B1 | 3/2004 | Campbell | |

(Continued)

*Primary Examiner* — Marie D Bays

(74) *Attorney, Agent, or Firm* — Husch Blackwell LLP

(57) ABSTRACT

A three-layered shoe construction having a slotted outsole with two different types of oval shaped projections, one set of oval projections with channels and one set of oval projections with a non-skid texture, the oval projections with channels creating flow channels to guide liquid off the outer surface of the outsole and the oval projections with a non-skid texture providing traction; a dual density midsole having a first density in the forefoot area and a second density in the hind foot area, the second density being greater than the first density; and an insole having a plurality of apertures that extend from a terminal end of the toe area and cover the rest of the top face except for the arch portion, the toe and arch areas of the insole being substantially smooth. The specific construction associated with the outsole, midsole and insole enhance traction, flexibility, cushioning, comfort, and breathability.

19 Claims, 6 Drawing Sheets

(56) References Cited

U.S. PATENT DOCUMENTS

| | | | | |
|---|---|---|---|---|
| 6,817,117 | B1 | 11/2004 | Campbell | |
| 7,610,695 | B2 | 11/2009 | Hay | |
| 7,637,034 | B2 | 12/2009 | Ailey et al. | |
| 7,814,686 | B2 * | 10/2010 | Becker | A43B 13/026 36/102 |
| 8,365,440 | B2 * | 2/2013 | Rivas | A43B 3/0036 36/107 |
| 2002/0004999 | A1 | 1/2002 | Caine et al. | |
| 2002/0078598 | A1 | 6/2002 | Bell | |
| 2004/0111920 | A1 * | 6/2004 | Cretinon | A43B 13/026 36/30 R |
| 2006/0156585 | A1 * | 7/2006 | Romero-Sanchez | A43B 13/20 36/59 R |
| 2007/0277401 | A1 | 12/2007 | Young-Chul | |
| 2008/0289220 | A1 * | 11/2008 | Rivas | A43B 3/0036 36/88 |
| 2009/0090031 | A1 | 4/2009 | Jung | |
| 2009/0188131 | A1 | 7/2009 | Doerer et al. | |
| 2009/0307932 | A1 | 12/2009 | Kirby et al. | |
| 2011/0088287 | A1 * | 4/2011 | Auger | A43B 5/02 36/107 |
| 2013/0055596 | A1 * | 3/2013 | Wan | A43B 13/141 36/25 R |
| 2015/0128455 | A1 * | 5/2015 | Lubart | A43B 13/22 36/25 R |
| 2015/0135558 | A1 * | 5/2015 | Inomata | A43B 13/14 36/25 R |
| 2015/0313312 | A1 * | 11/2015 | Park | A43B 13/122 36/31 |

* cited by examiner

THREE LAYER SHOE CONSTRUCTION WITH IMPROVED CUSHIONING AND TRACTION

FIELD OF THE INVENTION

The present invention relates to a shoe construction and, more particularly, to a three layered shoe construction with an outsole having a slotted and ribbed non-skid flexible traction exterior face to enhance flexibility and comfort, a dual density midsole having mating projections for registering with the slots of the outsole, and an insole having a raised grid pattern for increased breathability and comfort coupled with a raised arch area for providing additional support to the arch of the foot.

BACKGROUND OF THE INVENTION

Numerous shoes, covering a broad range of different designs and styles have been manufactured and sold in the marketplace. While shoes are worn to provide protection to one's feet, to reduce the impact felt when walking on hard surfaces, to provide support for the feet, and to prevent pronation, shoe designers must still seek to provide optimum levels of stability and comfort. In order to accomplish all of these objectives, shoe designers have used a wide variety of different tools and methods including heel plugs, shanks, contoured soles, deformable pillars or columns, spring-like structures, different traction designs, cushioning members, different shank designs, different ventilation structures, rocker elements, pads, gels and sole constructions having a plurality of different layers. Although these methods can be effective, the large number of components can result in increased manufacturing costs and complexity. It is therefore desirable to improve cushioning, flexibility, support and stability without increasing the number of components to achieve the same level of comfort for the user.

SUMMARY OF THE INVENTION

The present invention is directed to a three layer shoe construction which includes an outsole, midsole, and insole. The three layers have a mating relationship which will be later described in detail. The three components of the present shoe are preferably secured together through conventional means such as through cementing and/or adhesives thereby preventing relative movement between the layers during assembly and use of the present shoe. Each of the three layers of the present shoe are generally in the shape of a human foot and can be divided into different sections according to the three different regions of the human foot—the forefoot, the midfoot, and the hind foot. The forefoot is generally adjacent to and includes the toe area; the hind foot is generally adjacent to and includes the heel area; and the midfoot is located adjacent to both the forefoot and the hind foot. The ball of the foot is generally the area of the foot at the juncture between the metatarsal bones and the phalange bones. The two primary regions of the foot for load bearing when walking or standing normally are the ball area and the heel area, and the major bending of the shoe during normal use is typically in the ball area. The arch or instep is positioned between the heel and ball areas and flexes very little when walking normally.

The present outsole is made out of a super lightweight thermoplastic rubber (TPR) and includes an exterior and interior face. The exterior face of the present outsole engages the ground or other walking surfaces, while the interior face is located opposite the exterior face and has a mating relationship with the midsole as will be hereinafter further described in more detail.

The exterior face of the outsole includes a first section, a second section, and a third section located and positioned at approximately the forefoot, midfoot, and hind foot areas respectively. The first and third sections of the outsole cover substantially the entire forefoot and hind foot area. The second section, on the other hand, does not substantially cover the entire midfoot area but instead connects the first and third sections. The second section is adjacent and attaches to the first section on its medial side, while the second section is also adjacent and attaches to the third section on its lateral side.

All three sections of the exterior face of the outsole have a plurality of oval shaped projections. The first and third sections have two types of oval shaped projections—oval shaped projections with channels and oval shaped projections with a non-skid texture. The oval shaped projections with channels cover the majority of the forefoot and hind foot area, and each have a plurality of generally horizontal channels, or grooves, across its surface. Each channel is defined by a pair of opposing sidewalls and a groove surface in a second plane. The groove surface and pair of opposing sidewalls create fluid flow channels to help guide liquid off the outer surface and to the outer perimeter of the outsole, thereby preventing the outer surface from becoming slippery. Another added benefit of the oval shaped projections with channels is the increased flexibility in the outsole which allows a person to walk with a more natural stride instead of unnaturally constraining the foot.

In addition to the oval shaped projections with channels, the forefoot and hind foot areas of the exterior face of the outsole also include oval shaped projections with a non-skid texture that only covers a portion of the forefoot and hind foot area. More specifically, the oval shaped projections with a non-skid texture cover the entire midfoot area of the exterior face of the outsole, and extend from the midfoot area into a portion of the forefoot and hind foot areas. The oval shaped projections with a non-skid texture provides for better traction and prevents the wearer from slipping when the shoe is worn.

Another feature of the outsole is that its first and third sections have a plurality of slots. The first section includes a plurality of slots wherein the slots extend inwardly from both the medial and lateral side edges of the outsole. The third section also includes a plurality of slots which extend inwardly only from the lateral edge of the outsole. The plurality of slots have a mating relationship with the midsole which will be explained hereafter.

The midsole is made of a dual density blown ethylene-vinyl acetate copolymer (EVA) with an intrinsic molded arch support which supports the arch of the foot. The EVA creates a lightweight and resilient midsole, which helps dissipate shock when walking or running. In addition to the material itself, the dual density of the midsole allows for a greater flexibility and cushioning in the forefoot area due to its lighter density, and provides greater support and stability in the hind foot area due to its heavier density. The sidewall of the midsole extends completely around the perimeter of the midsole and includes a scored pattern around at least a portion of the sidewall, wherein the scored pattern is a series of horizontal lines. The series of horizontal lines help absorb and dissipate shock.

The midsole includes a proximal and distal face. The distal face of the midsole includes a plurality of ribs which correspond to the slots of the outsole. Each rib includes a channel or groove for dissipating water or another liquid and one set of ribs starts at the outer perimeter of the lateral edge of the midsole and extends inwardly towards the medial edge of the midsole in the forefoot and hind foot areas. Another set of ribs starts at the medial edge of the forefoot area and extends inwardly towards the lateral edge of the midsole. In addition to the plurality of ribs, the distal face of the midsole also includes two protrusions at the midfoot area which correspond to the shape of the outsole at its midfoot area. In other words, the first protrusion forms a somewhat triangular shape wherein a first side of the first protrusion is the medial side of the midsole's outer perimeter, a second side starts at the top of the first side closer to the forefoot area, and continues inwardly at an increasing angle before forming a third side by continuing outwards towards the midsole's outer perimeter. Similarly to the first protrusion, the second protrusion is also in the midfoot area and forms a somewhat right triangular shape opposite to the first protrusion adjacent to the lateral edge portion of the midsole. The two protrusions and ribs form a plurality of channels or spaces located at a lower level than the raised ribs which correspond to the slotted forefoot and hind foot areas of the outsole and the midfoot portion of the outsole, thereby allowing the outsole to have a mating relationship with the midsole. The outsole mates with and is received by the plurality of channels formed on the distal face of the midsole.

The proximal face of the midsole includes a lip around the entire circumference of the midsole thereby creating a cavity substantially in the shape of the midsole. The insole mates with and is received by the cavity created by the lip on the proximal face. The three layers are preferably secured together to prevent movement when worn.

The insole is a lightweight, thermal molded EVA with an antimicrobial shield which provides protection against bacteria, fungus, and controls or eliminates odors, stains, and product deterioration. This can be accomplished by adding a powder or other antimicrobial agents during the manufacturing process. The insole has a top face and a bottom face, wherein the top face engages with the foot of a wearer and includes a plurality of diamond shaped apertures that provide both greater flexibility and breathability when the overall shoe is worn. In one embodiment, the diamond shaped apertures are spaced from approximately the terminal end of the toe area and cover the rest of the top face of the insole except for the arch portion. Both the top face of the insole at the toe and arch areas are substantially smooth.

The present three layer shoe construction absorbs shock, enhances comfort, and creates a unique propulsion effect, without requiring a vast number of components.

BRIEF DESCRIPTION OF THE DRAWINGS

For a better understanding of the various embodiments of the present invention, reference may be made to the accompanying drawings in which.

Figure 1:
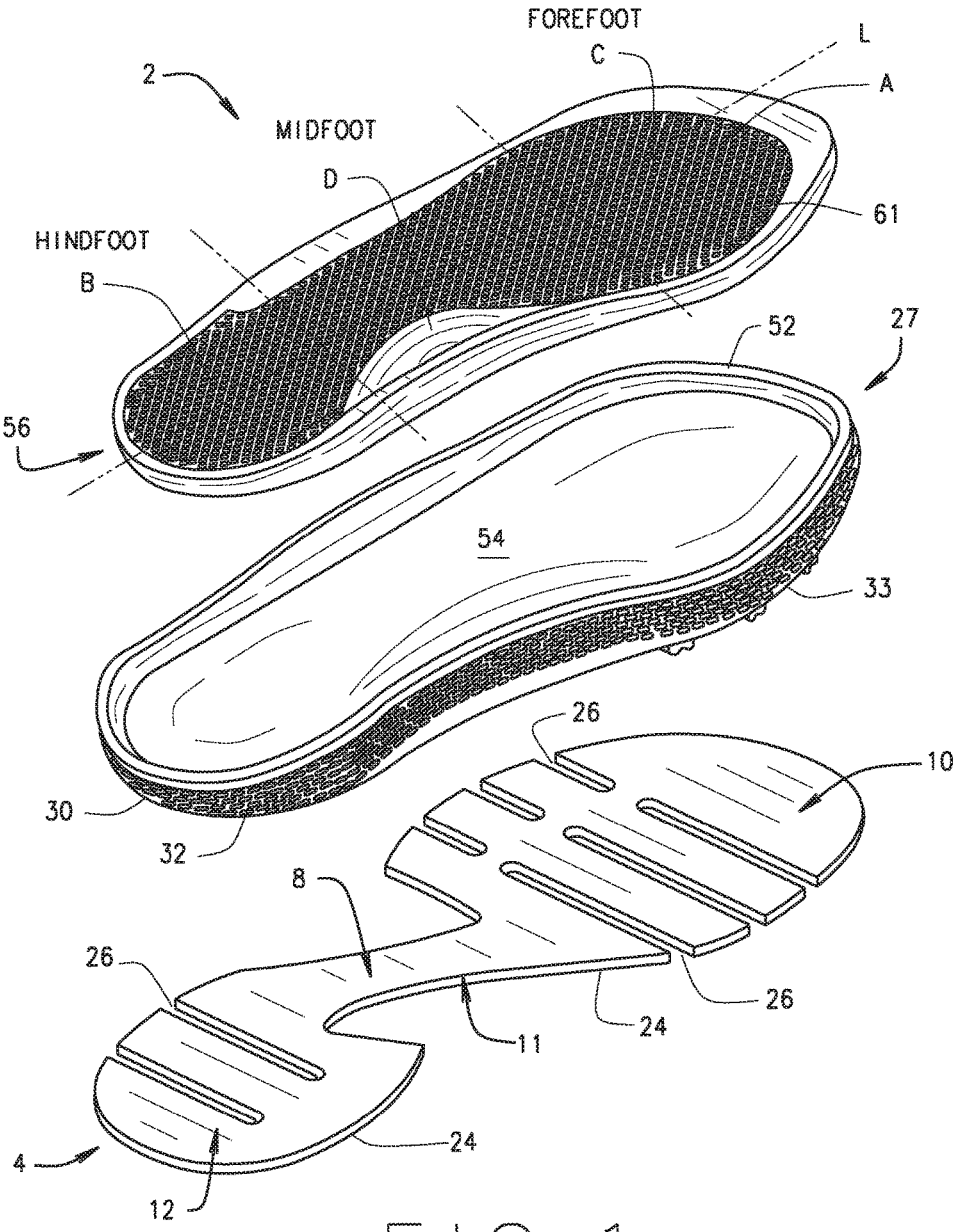
FIG. 1 is an exploded perspective view illustrating a shoe structure constructed according to the teachings of the present invention.

While the disclosure is susceptible to various modifications and alternative forms, specific embodiments thereof are shown by way of example in the drawings and will hereafter be described in detail. It should be understood, however, that the drawings and detailed description presented herein are not intended to limit the disclosure of the present invention to the particular embodiment disclosed, but on the contrary, the intention is to cover all modifications, equivalents, and alternatives falling within the spirit and scope of the present disclosure.

DETAILED DESCRIPTION OF THE DRAWINGS

The present invention will now be described with reference to the drawing figures in which like reference numerals refer to like parts throughout the disclosure. For purposes of clarity in illustrating the characteristics of the present invention, proportional relationships of the elements have not necessarily been maintained in the drawing figures.

As illustrated in FIG. 1, a three layer shoe construction 2 constructed in accordance with the teachings of the present invention includes an outsole 4, a midsole 27, and an insole 56. The outsole 4, midsole 27, and insole 56 have a mating relationship to each other as will be hereinafter further described. The combination of the three layers provides a unique cushioning and energizing propulsion effect, giving the wearer a sense of bouncing off of the ground. The layers of the present shoe are preferably secured together in a conventional manner such as through cementing and/or adhesives thereby preventing relative movement between the layers during assembly and use of the present shoe.

Each of the three layers of the present shoe are generally in the shape of a human foot and can be divided into different sections according to three distinct regions of the human foot—the forefoot, midfoot, and hind foot. The forefoot area or region of the foot is approximately adjacent to and includes the toe area A, while the hind foot area or region of the foot is approximately adjacent to and includes the heel area B. The midfoot area or region is approximately adjacent to both the forefoot and hind foot regions as illustrated in FIG. 1 and includes the arch area D. The ball area C of the foot is generally the area of the foot at the juncture between the metatarsal bones and the phalange bones. The two primary regions of the foot for load bearing when walking or standing normally includes the ball area C and the heel area B, and the major bending of the shoe during normal use is typically in the vicinity of the ball area C. The arch or instep area D is located between the heel area B and ball area C, and flexes very little when walking normally. The three layers of the present shoe also includes a longitudinal axis L, which extends through the forefoot, midfoot and hind foot, and can further be divided into a medial and lateral half. The medial half is located on the side of the longitudinal axis that includes the arch area D, while the lateral half is located on the other side of the longitudinal axis.

Figure 2:
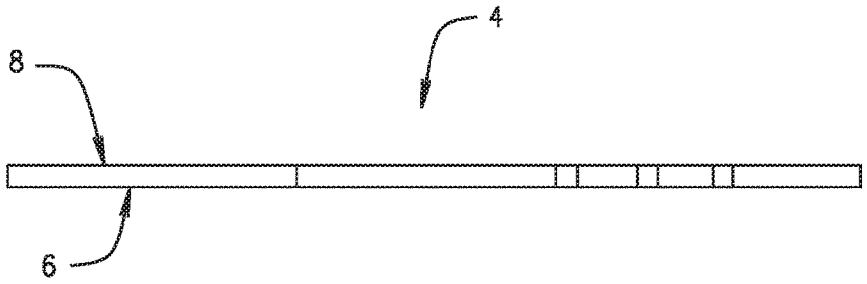
FIG. 2 is a side elevation view of the outsole of FIG. 1.

The present outsole 4 is made out of a super lightweight thermoplastic rubber (TPR) and includes an exterior face 6 and an interior face 8 as seen in FIG. 2. The exterior face 6 of the outsole 4 engages with the ground or other walking surfaces, while the interior face 8 has a mating relationship with the midsole 27 as will be hereinafter described in more detail.

Figure 3:
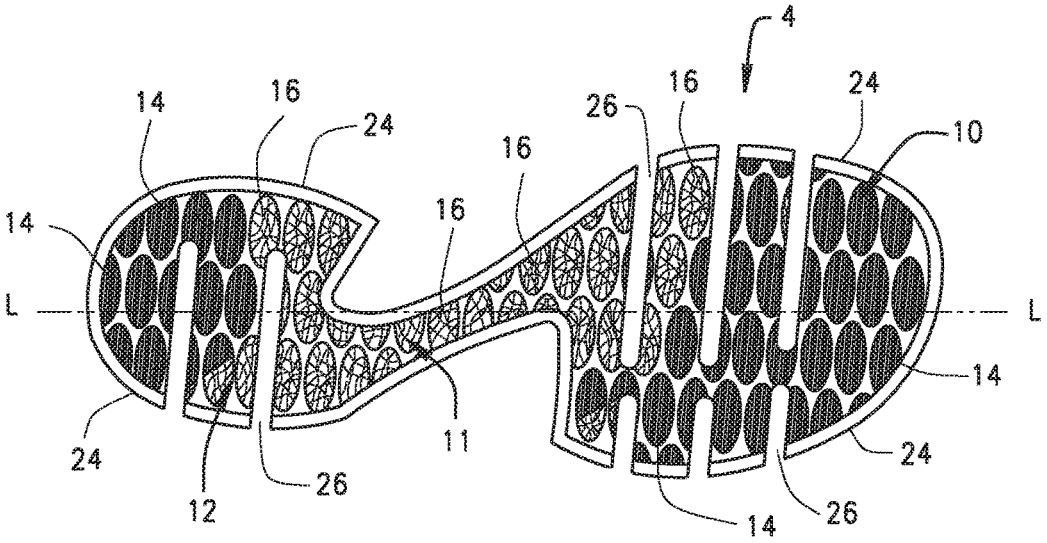
FIG. 3 is a bottom plan view of the outsole of FIGS. 1 and 2.
Figure 4:
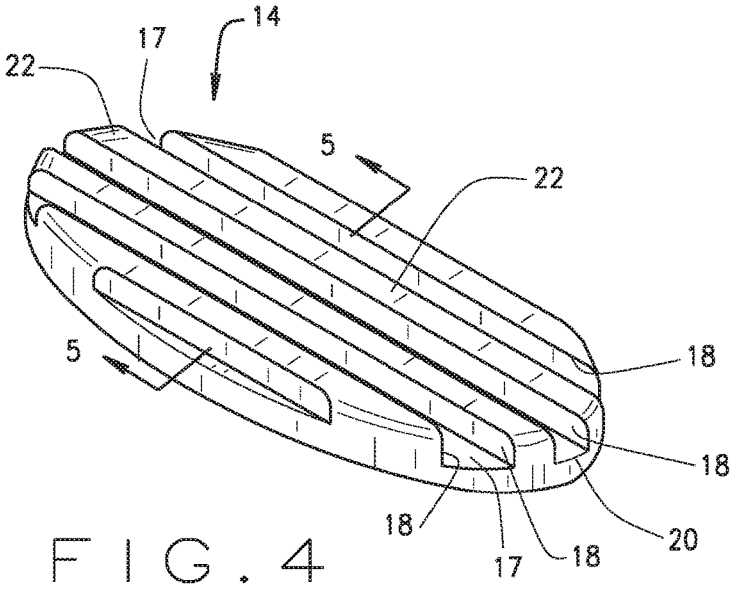
FIG. 4. is an enlarged view of one of the oval shaped projections with channels associated with the outsole of FIGS. 1 and 3.
Figure 5:
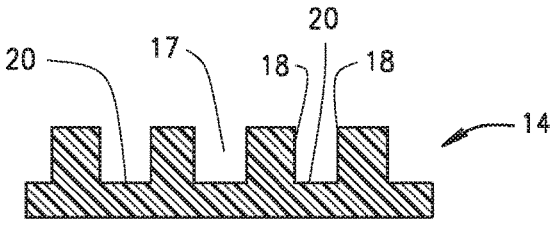
FIG. 5 is cross-section of an enlarged portion of the oval shaped projection taken across line 5-5 of FIG. 4.
Figure 9:
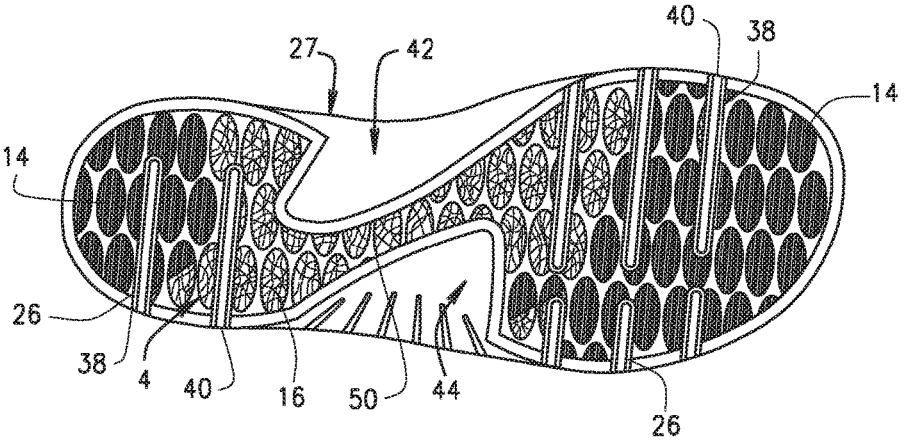
FIG. 9 is a bottom plan view of the outsole and midsole of FIGS. 1-8 mated together.

In one embodiment, the exterior face 6 of the outsole 4 includes a first section 10, a second section 11, and a third section 12, divided approximately into the forefoot, midfoot, and hind foot areas respectively as best illustrated in FIGS. 3 and 9. The first section 10 and the third section 12 of the outsole 4 cover substantially the entire forefoot and hind foot areas respectively while the second section 11, on the other hand, does not substantially cover the entire midfoot area, but instead connects the first and third sections 10, 12. The second section 11 is adjacent and attaches to the first section 10 on its medial side, while the second section 11 is adjacent and attaches to the third section 12 on its lateral side.

Turning to FIGS. 3-5 and 9, Sections 10, 11, and 12 of the outsole all have a plurality of oval shaped projections on the exterior face 6. The first section 10 and third section 12 have two types of oval shaped projections—oval shaped projections with channels 14 and oval shaped projections with a non-skid texture 16. The oval shaped projections with channels 14 cover the majority of the forefoot and hind foot area, and have a plurality of generally horizontal channels or grooves 17 which extend across each oval shaped projection 14. Each channel 17 is defined by a pair opposing sidewalls 18 and a bottom surface 20 in a second plane. The bottom surface 20 and the pair of opposing sidewalls 18 create a fluid flow channel 17 to guide liquid off of the outer surface 22 to the outer perimeter 24 of the outsole, thereby preventing the outer surface 22 from being slippery. The oval shaped projections with channels 14 also allow for increased traction and flexibility which allows a person to walk with a more natural stride instead of unnaturally constraining the foot.

In addition to the oval shaped projections with channels 14, the forefoot and hind foot areas also include oval shaped projections with a non-skid texture 16 which only cover a portion of the forefoot and hind foot areas. More specifically, the oval shaped projections with a non-skid texture 16 cover the entire midfoot portion of the outsole 4 and extend from the midfoot portion into a portion of the forefoot and the hind foot areas. The oval shaped projections with a non-skid texture 16 prevent the wearer from slipping when the shoe is worn.

Figure 6:
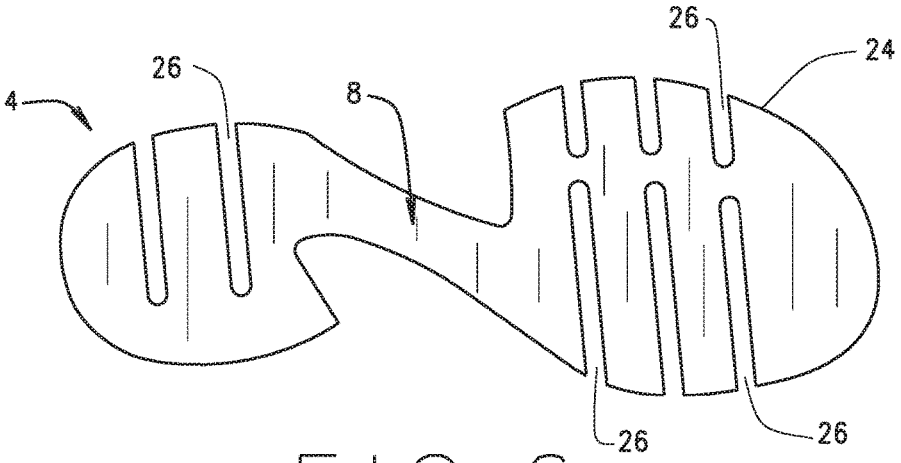
FIG. 6 is a top plan view of the outsole of FIGS. 1, 2, and 3.

In addition to the oval shaped projections 14 and 16, the first and third sections 10, 12 of the outsole also include a plurality of slots 26. In one embodiment, the first section 10 includes a plurality of slots 26 wherein the plurality of slots 26 extend inwardly from the outer perimeter 24 on both the medial and lateral side edges of the outsole 4 as best shown in FIGS. 3, 6 and 9. The third section 12 also includes a plurality of slots 26 that extend only from the lateral edge 24 of the outsole 4. The plurality of slots 26 have a mating relationship with the midsole 27, which will be hereinafter explained. The interior face 8 of the outsole 4 is substantially smooth as seen in FIG. 6.

Figure 11:
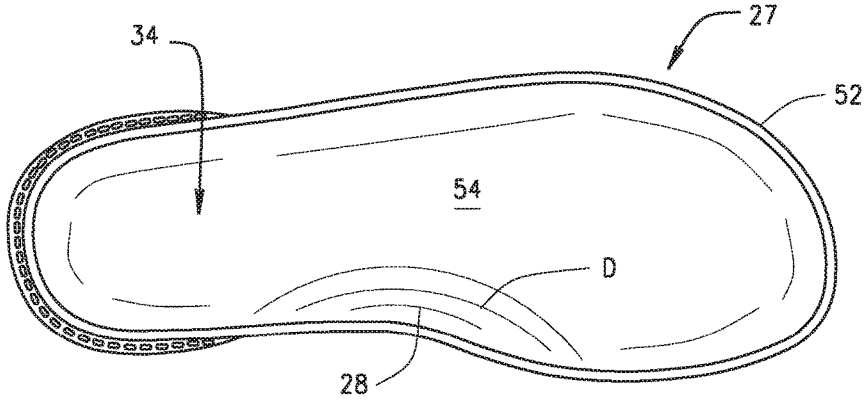
FIG. 11 is a top plan view of the midsole of FIGS. 1 and 7-9.

The midsole 27 is made of a dual density blown ethylene-vinyl acetate copolymer (EVA) with an intrinsic molded arch support 28 which supports the arch D of the foot which is best shown in FIG. 11. The EVA creates a lightweight and resilient midsole 27 which helps dissipate shock when walking or running. In addition to the material itself, the dual density of the midsole 27 allows for a greater flexibility and cushioning in the forefoot area due to its lighter density, and provides greater support and stability in the hind foot area due to its heavier density. In simple terms, the forefoot area of the present midsole 27 has a lighter density as compared to a heavier density heel area.

Figure 7:
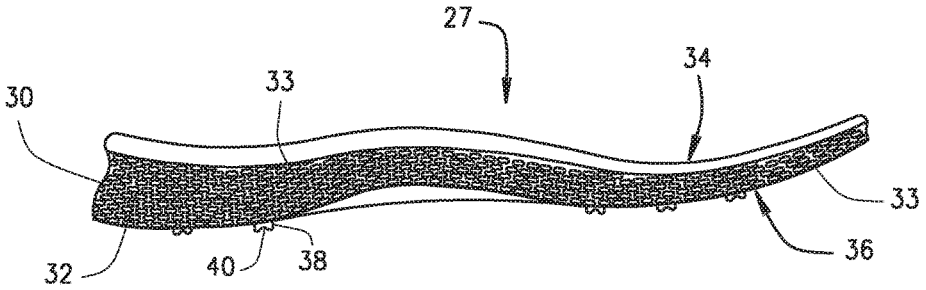
FIG. 7 is a side elevation view of the midsole of FIG. 1.

The sidewall 30 of the midsole 27 extends completely around the perimeter of the midsole 27 and includes a scored pattern 32 around at least a portion of the sidewall 30, wherein the scored pattern 32 includes a series of horizontally spaced projections 33 which are vertically arranged in spaced apart relationship which help absorb and dissipate shock as best illustrated in FIG. 7.

Figure 8:
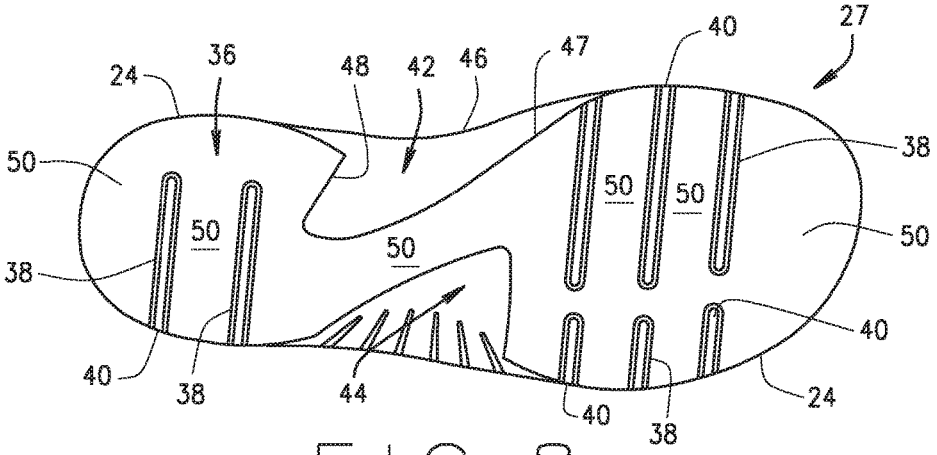
FIG. 8 is bottom plan view of the midsole of FIGS. 1 and 7.

The midsole 27 includes both a proximal face 34 and a distal face 36. Turning to FIG. 8, the distal face 36 includes a plurality of raised ribs 38 which correspond to the plurality of slots 26 of the outsole 4. Each rib 38 includes a flow channel or groove 40 for likewise guiding liquid off of the exterior face 6 of the outsole 4. Some of the plurality of ribs 38 extend inwardly from the lateral outer perimeter edge towards the medial edge of the midsole 27 in both the forefoot and hind foot areas while some of the plurality of ribs 38 also extend inwardly from the medial outer perimeter edge towards the lateral edge of the midsole 27 in the forefoot area as well. The plurality of ribs 38 provide for greater traction.

In addition to the plurality of ribs 38, the distal face 36 of the midsole 27 also includes a first protrusion 42 and a second protrusion 44 which correspond to the shape of the outsole 4 at its midfoot area. In other words, the first protrusion 42 forms a somewhat triangular shape wherein a first side 46 of the first protrusion 42 is positioned and located at the medial side of the outer perimeter 24 of the midsole in the midfoot area, a second side 47 starts at the top of first side 46, closer to the forefoot area, and continues inwardly at an increasing angle along second side 47 before forming a third side 48 by continuing outwards to the outer perimeter 24 in the midfoot area of the midsole. Similar to the first protrusion 42, the second protrusion 44 is also in the midfoot area of the midsole 27 and forms a somewhat right triangular shape opposite to the first protrusion 42, adjacent to the lateral edge of the midsole 27. The two protrusions 42, 44 and the plurality of ribs 38 form a plurality of channels or spaces 50 located at a lower level than the raised protrusions 42, 44 which correspond to the slotted outsole 4 thereby allowing the outsole 4 to have a mating relationship with the midsole 27.

Figure 10:
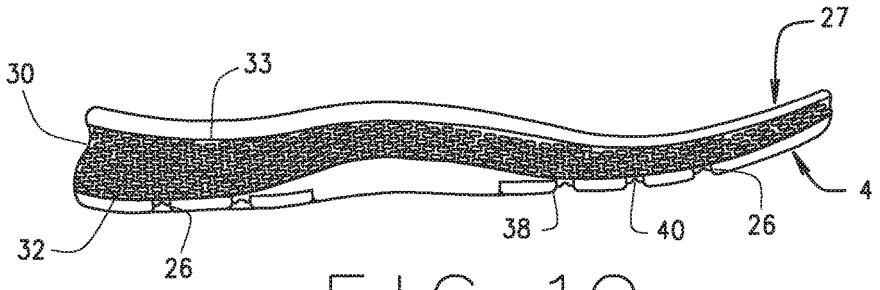
FIG. 10 is side elevation view of the outsole and midsole of FIG. 9.

FIGS. 9 and 10 show the interior face 8 of the outsole 4 mated with the distal face 36 of the midsole 27. As illustrated, the plurality of ribs 38 of the midsole 27 are received within the plurality of slots 26 of the outsole 4, and midfoot section 11 of the outsole 4 is received within the channel 50 of the midsole 27 located between the first and second protrusions 42 and 44 in the midfoot area of the distal face 36. In other words, the outsole 4 mates with and is received by the plurality of channels 50 created by the plurality of ribs 38 and two protrusions 42, 44 on the distal face of the midsole 27. This arrangement provides for a more streamline mating engagement between the outsole and the midsole 27 while still providing cushioning, flexibility, and traction.

Figure 12:
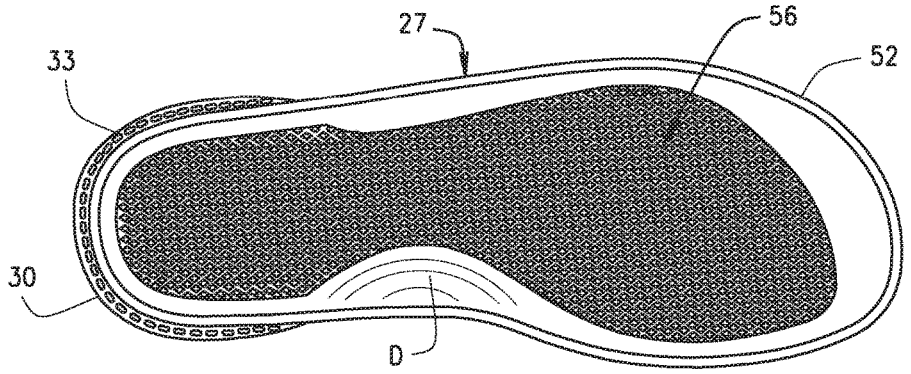
FIG. 12 is a top plan view of the midsole and insole of FIG. 1 mated together.

The proximal face 34 of the midsole 27 includes a lip 52 around the entire circumference of the midsole 27 thereby creating a cavity 54 substantially in the shape of the insole 56 as best illustrated in FIGS. 11 and 12. The insole 56 mates with and is received by the cavity 54 created by the lip 52 on the proximal face 34 of the midsole 27 as illustrated in FIG. 12. The three layers are preferably secured together by cementing and/or adhesives thereby preventing relative movement between the layers during assembly and use of the present shoe.

Figure 13:
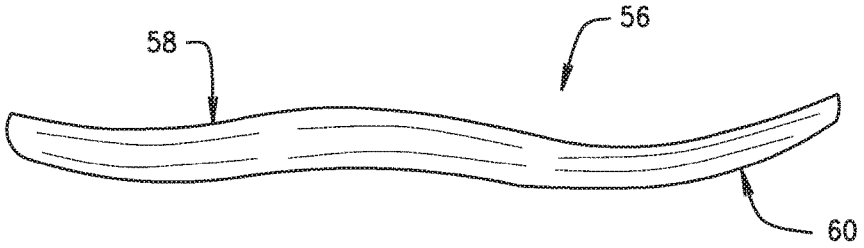
FIG. 13 is a side elevation view of the insole of FIGS. 1 and 12.
Figure 14:
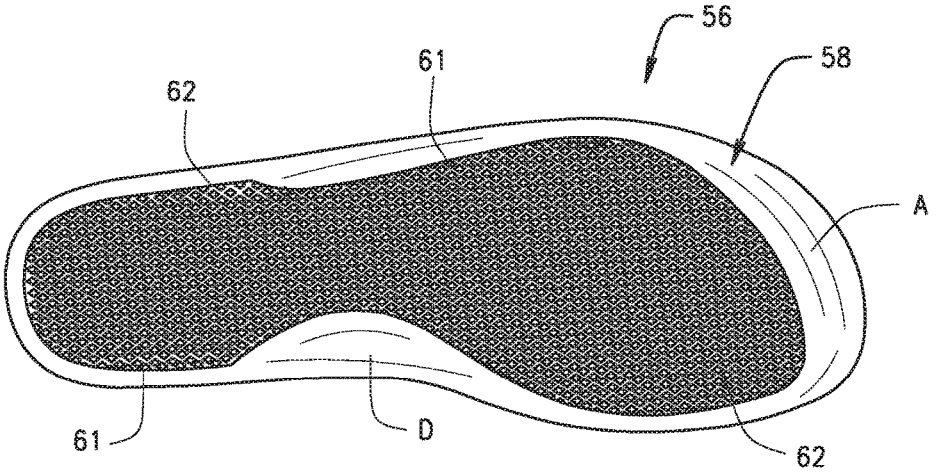
FIG. 14 is a top plan view of the insole of FIGS. 1, 12, and 13.
Figure 15:
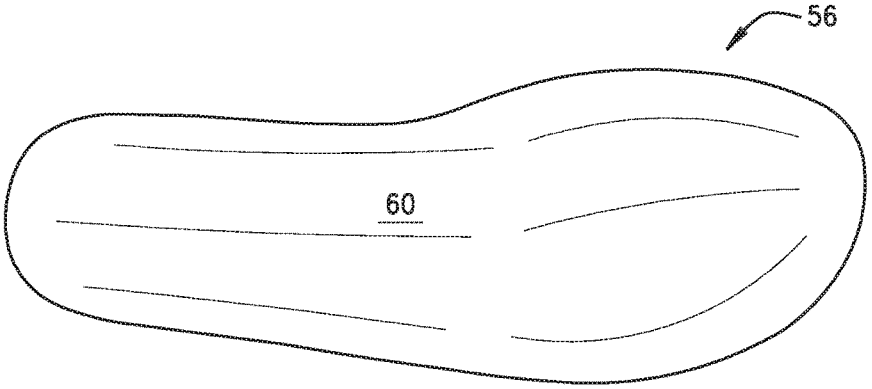
FIG. 15 is a bottom plan view of the insole of FIGS. 1, 12, 13 and 14.

The insole 56 is a lightweight, thermal molded EVA with an antimicrobial shield which provides protection against bacteria, fungus, and controls or eliminates odors, stains, and product deterioration. This can be accomplished by adding a powder or other antimicrobial agents during the manufacturing process. The insole 56 has a top face 58 and a bottom face 60 as best illustrated in FIG. 13. Turning to FIG. 14, the top face 58 engages with the foot of a wearer and includes a plurality of apertures 61 that provides both greater flexibility and breathability when worn. In one embodiment, the plurality of apertures 61 are diamond shaped apertures and begin from approximately the terminal end of the toe area A and cover the remainder of the top face 58 of the insole 56 except for the arch area D. The plurality of apertures 61 form a raised grid pattern 62 which provides additional cushioning and breathability when worn. The toe area A and the arch area D of the top face 58 are substantially smooth. The combination of the outsole 4, midsole 27, and insole 56 allows for great shock absorption, cushioning, flexibility and also produces a unique energizing propulsion effect. The bottom face 60 is likewise substantially smooth and is received by the cavity 54 of the midsole 27 as best illustrated in FIG. 15.

From the foregoing, it will be seen that the various embodiments of the present invention are well adapted to attain all the objectives and advantages hereinabove set forth together with still other advantages which are obvious and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles and scope of the present invention.

Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A shoe construction comprising:

an outsole having an outer perimeter, an exterior face, an interior face, a medial side, a lateral side, a forefoot area, a midfoot area, and a hind foot area, the exterior face including a first section located in the vicinity of the forefoot area, a second section located in the vicinity of the midfoot area, and a third section located in the vicinity of the hind foot area, the second section being attachable to the first section on the medial side of the outsole and being attachable to the third section on the lateral side on the outsole, each of the first and third sections including a plurality of oval shaped projections with channels, each of the first, second, and third sections including a plurality of oval shaped projections with a non-skid texture, each of the first and third sections including a plurality of slots wherein the plurality of slots on the first section extend inwardly from the outer perimeter on both the medial and lateral sides of the outsole, and wherein the plurality of slots on the third section extend inwardly from the outer perimeter only from the lateral side of the outsole;

a midsole having a proximal face, a distal face, a medial side, a lateral side, an outer perimeter, a forefoot area, a midfoot area, and a hind foot area, the midsole having a first density in the forefoot area and a second density in the hind foot area, the distal face of the midsole having a plurality of ribs in the forefoot and hind foot areas, at least some of the plurality of ribs in the forefoot area extend inwardly from the lateral side towards the medial side of the midsole and at least some of the plurality of ribs in the forefoot area extend inwardly from the medial side towards to the lateral side of the midsole, the plurality of ribs in the hind foot area extend inwardly from the lateral side towards the medial side of the midsole, the distal face of the midsole further having a first protrusion and a second protrusion in the midfoot area, said plurality of ribs, the first protrusion, and the second protrusion form a plurality of channels on the distal face, the midsole having a cavity located and positioned on its proximal face; and an insole having a top face, a bottom face, a medial side, a lateral side, a forefoot area, a midfoot area, a hind foot area, a toe area, an arch area, and a heel area, the top face of the insole including a plurality of apertures except for at least a portion of the toe area and arch area of the insole;

the plurality of channels on the distal face of the midsole being shaped and dimensioned to receive the outsole and the cavity on the proximal face of the midsole being shaped and dimensioned to receive the insole.

2. The shoe construction of claim 1 wherein the plurality of oval shaped projections with a non-skid texture extend from the vicinity of the midfoot into a portion of the forefoot and hind foot areas.

3. The shoe construction of claim 1 wherein the outsole is made of a super lightweight thermoplastic rubber.

4. The shoe construction of claim 1 wherein the midsole is made of an ethylene-vinyl acetate copolymer.

5. The shoe construction of claim 1 wherein the midsole includes a sidewall extending completely around the perimeter of the midsole, the sidewall including a scored pattern.

6. The shoe construction of claim 1 wherein the insole is made of a lightweight thermal molded EVA.

7. The shoe construction of claim 1 wherein the plurality of apertures on the top face of the insole starts at a terminal end of the toe area and extends across the remainder of the forefoot area, the lateral side of the midfoot area, and the hind foot area.

8. The shoe construction of claim 1 wherein the plurality of apertures are diamond shaped in configuration.

9. A three layered shoe construction comprising:

an outsole having an outer perimeter, an exterior face, an interior face, a medial side, a lateral side, a forefoot area, a midfoot area, and a hind foot area, the exterior face including a first section located in the vicinity of the forefoot area, a second section located in the vicinity of the midfoot area, and a third section located in the vicinity of the hind foot area, the second section lies adjacent to the first and third sections and attaches to the first section on the medial side of the outsole and attaches to the third section on the lateral side on the outsole, each of the first and third sections including a plurality of oval shaped projections having at least one channel associated respectively therewith, each of the first, second, and third sections including a plurality of oval shaped projections having a non-skid texture associated respectively therewith that extend from the vicinity of the midfoot area into a portion of the forefoot and hind foot areas, each of the first and third sections further including a plurality of slots wherein the plurality of slots on the first section extend inwardly from the outer perimeter on both the medial and lateral sides of the outsole, and wherein the plurality of slots on the third section extend inwardly from the outer perimeter only from the lateral side of the outsole;

a midsole having a proximal face, a distal face, a medial side, a lateral side, a forefoot area, a midfoot area and a hind foot area, the midsole having a first density in the forefoot area and a second density in the hind foot area, the distal face of the midsole having a plurality of ribs in the forefoot and hind foot areas, at least some of the plurality of ribs in the forefoot and hind foot areas extend inwardly from the outer perimeter of the midsole towards the medial side of the midsole and at least some of the plurality of ribs in the forefoot area extend inwardly from the outer perimeter of the midsole towards the lateral side of the midsole, the distal face of the midsole further including a first protrusion and a second protrusion in the midfoot area wherein the plurality of ribs, the first protrusion, and the second protrusion form a plurality of channels on the distal face, the midsole further having a cavity located and positioned on its proximal face; and an insole having a top face, a bottom face, a medial side, a lateral side, a forefoot area, a midfoot area, a hind foot area, a toe area, an arch area, and a heel area, the top face of the insole including a plurality of apertures that start from a terminal end of the toe area and extend across the remainder of the forefoot area, the lateral side of the midfoot area, and the hind foot area, the toe area and arch area of the top face of the insole being smooth;

the plurality of channels on the distal face of the midsole being shaped and dimensioned to receive the outsole and the cavity on the proximal face of the midsole being shaped and dimensioned to receive the insole.

10. The shoe construction of claim 9 wherein the outsole is made of a super lightweight thermoplastic rubber.

11. The shoe construction of claim 9 wherein the midsole is made of an ethylene-vinyl acetate copolymer.

12. The shoe construction of claim 9 wherein the insole is made of a lightweight thermal molded EVA.

13. The shoe construction of claim 9 wherein the midsole includes a sidewall extending completely around the perimeter of the midsole, the sidewall including a scored pattern across at least a portion thereof.

14. The shoe construction of claim 9 wherein each of the plurality of ribs on the midsole includes a channel.

15. A three layered shoe construction comprising:

an outsole having an outer perimeter, an exterior face, an interior face, a medial side, a lateral side, a forefoot area, a midfoot area, and a hind foot area, the exterior face including a first section located in the vicinity of the forefoot area, a second section located in the vicinity of the midfoot area, and a third section located in the vicinity of the hind foot area, the second section being located between the first and third sections and extending from the medial side of the first section of the outsole to the lateral side of the third section on the outsole, each of the first and third sections including a plurality of oval shaped projections each having a plurality of channels associated therewith, each of the first, second, and third sections including a plurality of oval shaped projections each having a non-skid texture associated therewith, said plurality of oval shaped projections having a non-skid texture extending from the vicinity of the midfoot area into a portion of the forefoot and hind foot areas, each of the first and third sections further including a plurality of slots each having a groove associated therewith wherein the plurality of slots on the first section extend inwardly from the outer perimeter on both the medial and lateral sides of the outsole, and wherein the plurality of slots on the third section extend inwardly from the outer perimeter only from the lateral side of the outsole;

a midsole having a proximal face, a distal face, a medial side, a lateral side, an outer perimeter, a forefoot area, a midfoot area, and a hind foot area, the midsole having a first density in the forefoot area and a second density in the hind foot area, the first density being less than the second density, the distal face of the midsole having a plurality of raised ribs in the forefoot and hind foot areas, at least some of the plurality of raised ribs in the forefoot and hind foot areas extend inwardly from the lateral side towards the medial side of the midsole and at least some of the plurality of raised ribs on the forefoot area also extend inwardly from the medial side towards the lateral side of the midsole, the distal face of the midsole further including a first protrusion and a second protrusion in the midfoot area wherein the plurality of raised ribs, the first protrusion, and the second protrusion form a plurality of channels on the distal face of the midsole, said plurality of channels being shaped and dimensioned so as to receive the outsole therewithin, the midsole having a cavity located and positioned on its proximal face and having a sidewall extending completely around the perimeter of the midsole, at least a portion of the sidewall including a scored pattern; and an insole having a top face, a bottom face, a medial side, a lateral side, a forefoot area, a midfoot area, a hind foot area, an outer perimeter, a toe area, an arch area, and a heel area, the top face of the insole including a plurality of apertures that start at a location spaced from the outer perimeter of the toe area and extend across the remainder of the forefoot area, across at least a portion of the midfoot area, and across the hind foot area, the toe area and arch area of the insole being smooth;

the cavity located on the proximal face of the midsole being shaped and dimensioned to receive the insole.

16. The shoe construction of claim 15 wherein the scored pattern associated with at least a portion of the sidewall of the midsole including a series of horizontally spaced projections.

17. The shoe construction of claim 15 wherein the plurality of apertures on the top face of the insole are diamond shaped in configuration.

18. The shoe construction of claim 15 wherein the plurality of apertures associated with the top face of the insole form a raised grid pattern.

19. The shoe construction of claim 15 wherein the insole includes an antimicrobial shield.

* * * * *